US011085308B2

(12) United States Patent
Bruni et al.

(10) Patent No.: US 11,085,308 B2
(45) Date of Patent: Aug. 10, 2021

(54) COMPRESSOR AEROFOIL

(71) Applicant: Siemens Aktiengesellschaft, Munich (DE)

(72) Inventors: Giuseppe Bruni, Lincoln (GB); Senthil Krishnababu, Lincoln (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 13 days.

(21) Appl. No.: 16/619,617

(22) PCT Filed: Jun. 14, 2018

(86) PCT No.: PCT/EP2018/065822
§ 371 (c)(1),
(2) Date: Dec. 5, 2019

(87) PCT Pub. No.: WO2019/001980
PCT Pub. Date: Jan. 3, 2019

(65) Prior Publication Data

US 2020/0157952 A1 May 21, 2020

(30) Foreign Application Priority Data

Jun. 26, 2017 (EP) ..... 17177882

(51) Int. Cl.
*F01D 5/20* (2006.01)
*F01D 5/18* (2006.01)
(Continued)

(52) U.S. Cl.
CPC ..... *F01D 5/20* (2013.01); *F01D 5/187* (2013.01); *F01D 5/141* (2013.01); *F04D 29/324* (2013.01);
(Continued)

(58) Field of Classification Search
CPC ..... F01D 5/20; F01D 5/141; F05D 2240/307
See application file for complete search history.

(56) References Cited

U.S. PATENT DOCUMENTS 4,875,831 A * 10/1989 Fetiveau ..... F01D 5/20 416/228
6,059,530 A 5/2000 Lee
(Continued)

FOREIGN PATENT DOCUMENTS

EP 0317432 A1 5/1989
EP 2696031 A1 2/2014
(Continued)

OTHER PUBLICATIONS

International search report and written opinion dated Sep 14, 2018, for corresponding PCT/EP2018/065822.

*Primary Examiner* — Eldon T Brockman

(57) ABSTRACT

A compressor aerofoil for a turbine engine includes a root portion spaced apart from a tip portion by a main body portion. The main body portion is defined by a suction surface wall having a suction surface, and a pressure surface wall having a pressure surface. The suction surface wall and the pressure surface wall meet at a leading edge and a trailing edge. The tip portion has a tip wall which extends from the aerofoil leading edge to the aerofoil trailing edge. The tip wall defines a squealer having: a first tip wall region which extends from the leading edge; a second tip wall region which extends from the trailing edge; and a third tip wall region which extends between the first tip wall region and the second tip wall region.

14 Claims, 6 Drawing Sheets

(51) Int. Cl.
*F01D 5/14* (2006.01)
*F04D 29/32* (2006.01)

(52) U.S. Cl.
CPC .. *F05B 2250/712* (2013.01); *F05D 2240/307* (2013.01); *F05D 2240/35* (2013.01); *F05D 2260/20* (2013.01)

(56) References Cited

U.S. PATENT DOCUMENTS

| | | | | |
|---|---|---|---|---|
| 8,790,088 | B2 * | 7/2014 | Dyer | F01D 5/20 416/228 |
| 9,399,918 | B2 * | 7/2016 | Geppert | F04D 29/681 |
| 10,633,983 | B2 * | 4/2020 | Barua | F01D 5/20 |
| 2007/0258815 | A1 | 11/2007 | Liang | |
| 2014/0044553 | A1 * | 2/2014 | Geppert | F04D 29/324 416/243 |

FOREIGN PATENT DOCUMENTS

| | | | |
|---|---|---|---|
| EP | 2960434 | A1 | 12/2015 |
| RU | 101497 | U1 | 1/2011 |

* cited by examiner

| Parameter | Value |
|---|---|
| $h_{2A}=h_{2B}=h_{2C}$ | 1.5 to $3.5h_g$ |
| $h_{1A}=h_{1B}=h_{1C}$ | 1.5 to $2.7h_{2A}$ |
| $W_{SA}$ | 0.3 to $0.6W_A$ |
| $W_{SB}$ | 0.3 to $0.6W_B$ |
| $W_{SC}$ | 0.3 to $0.6W_C$ |
| $L_1$ | 0.2 to 0.6L |
| $L_2$ | 0.2 to 0.6L |
| $L_3$ | 0.2 to 0.6L |

COMPRESSOR AEROFOIL

CROSS REFERENCE TO RELATED APPLICATIONS

This application is the US National Stage of International Application No. PCT/EP2018/065822 filed 14 Jun. 2018, and claims the benefit thereof. The International Application claims the benefit of European Application No. EP17177882 filed 26 Jun. 2017. All of the applications are incorporated by reference herein in their entirety.

FIELD OF INVENTION

The present invention relates to a compressor aerofoil.

In particular it relates to a compressor aerofoil rotor blade and/or compressor aerofoil stator vane for a turbine engine, and/or a compressor rotor assembly.

BACKGROUND

A compressor of a gas turbine engine comprises rotor components, including rotor blades and a rotor drum, and stator components, including stator vanes and a stator casing. The compressor is arranged about a rotational axis with a number of alternating rotor blade and stator vane stages, and each stage comprises an aerofoil.

The efficiency of the compressor is influenced by the running clearances or radial tip gap between its rotor and stator components. The radial gap or clearance between the rotor blades and stator casing and between the stator vanes and the rotor drum is set to be as small as possible to minimise over tip leakage of working gases, but sufficiently large to avoid significant rubbing that can damage components. The pressure difference between a pressure side and a suction side of the aerofoil causes the working gas to leak through the tip gap. This flow of working gas or over-tip leakage generates aerodynamic losses due to its viscous interaction within the tip gap and with the mainstream working gas flow particularly on exit from the tip gap. This viscous interaction causes loss of efficiency of the compressor stage and subsequently reduces the efficiency of the gas turbine engine.

Two main components to the over tip leakage flow have been identified, which is illustrated in FIG. 1, which shows an end on view of a tip 1 of an aerofoil 2 in situ in a compressor, thus showing a tip gap region. A first leakage component "A" originates near a leading edge 3 of the aerofoil at the tip 1 and which forms a tip leakage vortex 4, and a second component 5 that is created by leakage flow passing over the tip 1 from the pressure side 6 to the suction side 7. This second component 5 exits the tip gap and feeds into the tip leakage vortex 4 thereby creating still further aerodynamic losses.

Hence an aerofoil design which can reduce either or both tip leakage components is highly desirable.

SUMMARY

According to the present disclosure there is provided apparatus as set forth in the appended claims. Other features of the invention will be apparent from the dependent claims, and the description which follows.

Accordingly there may be provided a compressor aerofoil (70) for a turbine engine, the compressor aerofoil (70) comprising: a root portion (72) spaced apart from a tip portion (100) by a main body portion (102); the main body portion (102) defined by: a suction surface wall (88) having a suction surface (89), a pressure surface wall (90) having a pressure surface (91), whereby the suction surface wall (88) and the pressure surface wall (90) meet at a leading edge (76) and a trailing edge (78). The tip portion (100) may comprise: a tip wall (106) which extends from the aerofoil leading edge (76) to the aerofoil trailing edge (78). The tip wall (106) may define: a squealer (110) comprising: a first tip wall region (112) which extends from the leading edge (76); a second tip wall region (114) which extends from the trailing edge (78); a third tip wall region (116) which extends between the first tip wall region (112) and the second tip wall region (114). Preferably, the first tip wall region (112), third tip wall region (116) and second tip wall region (114) are joined to form a continuous tip wall (106) that provides or forms the squealer (110).

The tip wall (106) defines a tip surface (118) which may extend from the aerofoil leading edge (76) to the aerofoil trailing edge (78).

In the first tip wall region (112) a pressure-side shoulder (104) may be provided on the pressure surface wall (90) which extends from the leading edge (76) part of the way towards the trailing edge (78); a transition region (108) of the pressure surface wall (90) may taper from the pressure-side shoulder (104) in a direction towards the tip wall (106); and the suction surface (89) may extend towards the first tip wall region (112).

In the second tip wall region (114) a suction-side shoulder (105) may be provided on the suction surface wall (88) which extends from the trailing edge (78) part of the way towards the leading edge (76); a transition region (109) of the suction surface wall (88) may taper from the suction-side shoulder (105) in a direction towards the tip wall (106); and the pressure surface (91) may extend towards the second tip wall region (114).

In the third tip wall region (116) the pressure surface wall (90) transition region (108) may taper from the pressure-side shoulder (104) in a direction towards the tip wall (106); and the suction surface wall (88) transition region (109) may taper from the suction-side shoulder (105) in a direction towards the tip wall (106).

The pressure-side shoulder (104) may substantially only overlap the suction side shoulder (105) in the third tip wall section (116).

The first tip wall region (112) may taper in width wsA from the third tip wall region (116) to the leading edge (76). The second tip wall region (114) may taper in width wsC from the third tip wall region (116) to the trailing edge (78).

The squealer width wsA in the first tip wall region (112) may have a value of at least 0.3, but no more than 0.6, of the distance wA between pressure surface (91) and the suction surface (89) in the region of the main body portion (102) corresponding to the first tip wall region (112).

The squealer width wsC in the second first tip wall region (114) may have a value of at least 0.3, but no more than 0.6, of the distance wC between pressure surface (91) and the suction surface (89) in the region of the main body portion (102) corresponding to the second tip wall region (114).

The squealer width wsB in the third tip wall region (116) may have a value of at least 0.3, but no more than 0.6, of the distance wB between pressure surface (91) and the suction surface (89) in the region of the main body portion (102) corresponding to the third tip wall region (116).

A chord line from the leading edge (76) to the trailing edge (78) has a length L; and the first tip wall region (112) has a chord length L1, the second tip wall region (114) has a chord length L3 and the third tip wall region (116) has a chord length L2, wherein the sum of L1, L2 and L3 may be equal to L.

The first tip wall region (112) may have a chord length L1 of at least 0.2 L but no more than 0.6 L. The second tip wall region (114) may have a chord length L3 of at least 0.2 L but no more than 0.6 L. The third tip wall region (116) may have a chord length L2 of at least 0.2 L but no more than 0.6 L.

The tip wall (106) may define a tip surface (118) which extends from the aerofoil leading edge (76) to the aerofoil trailing edge (78). The transition region (108) of the pressure surface wall (90) may extend from the pressure side shoulder (104) in a direction towards the suction surface (89). At a pressure side inflexion point (120) the transition region (108) may curve to extend in a direction away from the suction surface (89) toward the tip surface (118). The transition region (109) of the suction surface wall (88) may extend from the pressure side shoulder (105) in a direction towards the pressure surface (91). At a suction side inflexion point (121) the transition region (109) may curve to extend in a direction away from the pressure surface (91) toward the tip surface (118).

The tip portion (100) may further comprise: a pressure surface inflexion line (122) defined by a change in curvature on the pressure surface (91); the pressure side inflexion point (120) being provided on the pressure side inflexion line (122); the pressure side inflexion line (122) extending from the leading edge (76) part of the way to the trailing edge (78);

The tip portion (100) may further comprise a suction surface inflexion line (123) defined by a change in curvature on the suction surface (89); and the suction side inflexion point (121) being provided on the pressure side inflexion line (123); the suction side inflexion line (123) extending from the trailing edge (78) part of the way to the leading edge (76).

The pressure side inflexion line (122) may be provided a distance h2A from the tip surface (118) in the first tip wall region (112); the pressure side inflexion line (122) and suction side inflexion line (123) are provided a distance h2B from the tip surface (118) in the third tip wall region (116); and the suction side inflexion line (123) is provided a distance h2C from the tip surface (118) in the second tip wall region (114); and the shoulders (104, 105) are provided a distance h1A, h1B, h1C from the tip surface (118); where: h1A, h1B, h1C may be equal in value to each other; h2A, h2B, h2C may be equal in value to each other; and h1A, h1B, h1C may have a value of at least 1.5, but no more than 2.7, of distance h2A, h2B, h2C respectively.

The pressure surface (91) and the suction surface (89) are spaced apart by a distance wB in a region corresponding to the third tip wall region (116); and the distance wA between the pressure surface (91) and the suction surface (89) in the first tip wall region (112) may decrease in value from the distance wB towards the leading edge (76); and the distance wB between the pressure surface (91) and the suction surface (89) in the second tip wall region (114) may decrease in value from the distance wB towards the trailing edge (78).

There may also be provided a compressor rotor assembly for a turbine engine, the compressor rotor assembly comprises a casing and a compressor aerofoil according to the present disclosure wherein the casing and the compressor aerofoil 70 define a tip gap hg defined between the tip surface 118 and the casing 50. The distance h2A, h2B, h2C from the inflexion line to the tip surface 118 may have a value of at least 1.5 hg but no more than 3.5 hg.

Hence there is provided an aerofoil for a compressor which is reduced in thickness towards its tip to form a suction side squealer for the leading part of the aerofoil and a pressure side squealer for the trailing part of the aerofoil with a shaped bridge squealer connecting the leading and trailing parts of the squealer. Together, these features reduce the tip leakage mass flow thus diminishing the strength of the interaction between the leakage flow and the main stream flow which in turn reduces loss in efficiency relative to examples of the related art.

Hence the compressor aerofoil of the present disclosure provides a means of controlling losses by reducing the tip leakage flow.

BRIEF DESCRIPTION OF THE DRAWINGS

Examples of the present disclosure will now be described with reference to the accompanying drawings, in which.

DETAILED DESCRIPTION

Figure 2:
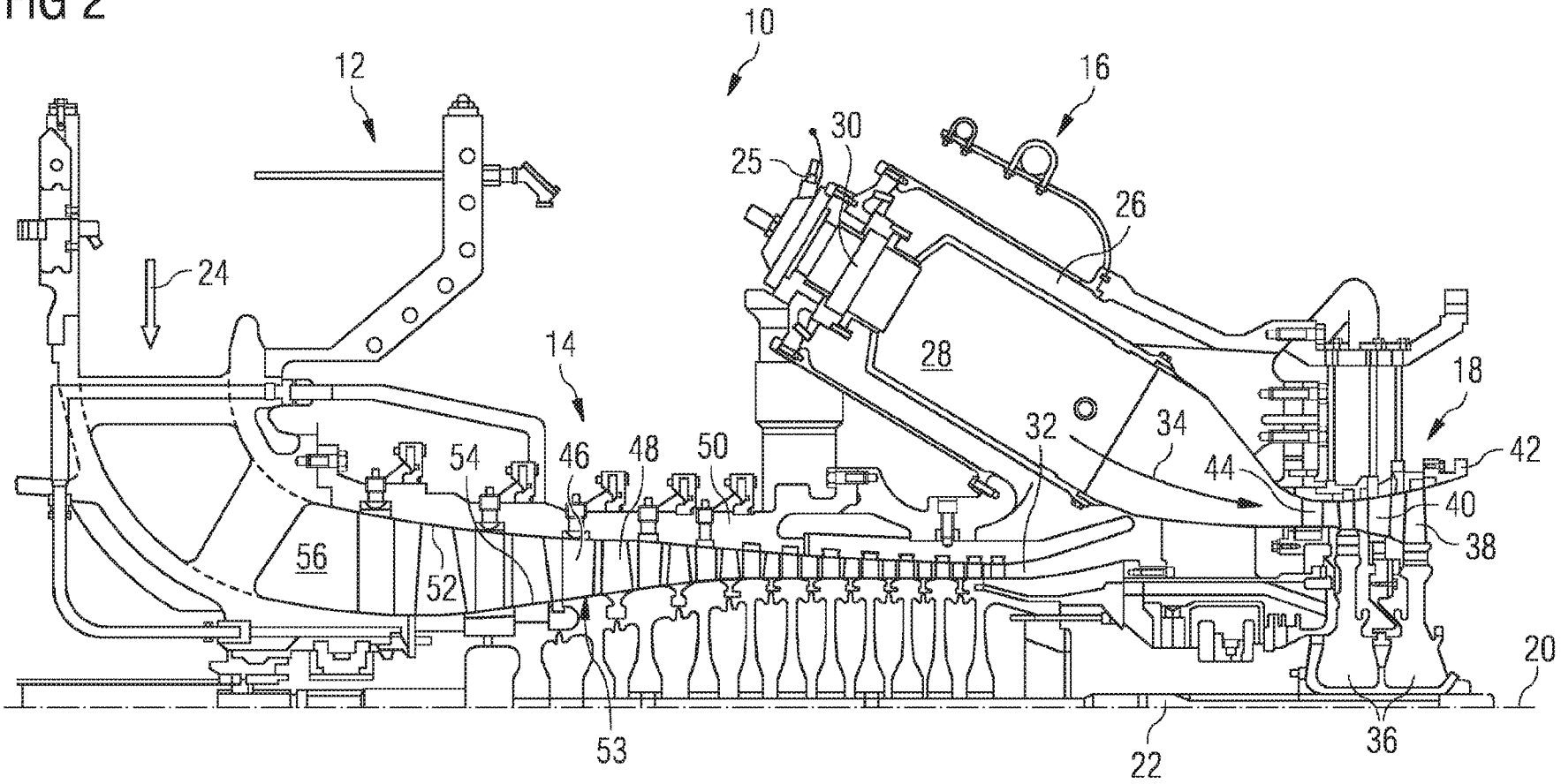
FIG. 2 shows part of a turbine engine in a sectional view and in which an aerofoil of the present disclosure may be provided.

FIG. 2 shows an example of a gas turbine engine 10 in a sectional view which may comprise an aerofoil and compressor rotor assembly of the present disclosure.

The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28.

The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the resulting combustion gas 34 or working gas from the combustion is channeled through the combustion chamber 28 to the turbine section 18.

The turbine section 18 comprises a number of blade carrying discs 36 attached to the shaft 22. In addition, guiding vanes 40, which are fixed to a stator 42 of the gas turbine engine 10, are disposed between the stages of annular arrays of turbine blades 38. Between the exit of the combustion chamber 28 and the leading turbine blades 38, inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

Compressor aerofoils (that is to say, compressor rotor blades and compressor stator vanes) have a smaller aspect ratio than turbine aerofoils (that is to say, turbine rotor blades and turbine stator vanes), where aspect ratio is defined as the ratio of the span (i.e. width) of the aerofoil to the mean chord (i.e. straight line distance from the leading edge to the trailing edge) of the aerofoil. Turbine aerofoils have a relatively large aspect ratio because they are necessary broader (i.e. wider) to accommodate cooling passages and cavities, whereas compressor aerofoils, which do not require cooling, are relatively narrow.

Compressor aerofoils also differ from turbine aerofoils by function. For example compressor rotor blades are configured to do work on the air that passes over them, whereas turbine rotor blades have work done on them by exhaust gas which pass over them. Hence compressor aerofoils differ from turbine aerofoils by geometry, function and the working fluid which they are exposed to. Consequently aerodynamic and/or fluid dynamic features and considerations of compressor aerofoils and turbine aerofoils tend to be different as they must be configured for their different applications and locations in the device in which they are provided.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 46. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48 and will be described in more detail below.

The aerofoil of the present disclosure is described with reference to the above exemplary turbine engine having a single shaft or spool connecting a single, multi-stage compressor and a single, one or more stage turbine. However, it should be appreciated that the aerofoil of the present disclosure is equally applicable to two or three shaft engines and which can be used for industrial, aero or marine applications. The term rotor or rotor assembly is intended to include rotating (i.e. rotatable) components, including rotor blades and a rotor drum. The term stator or stator assembly is intended to include stationary or non-rotating components, including stator vanes and a stator casing. Conversely the term rotor is intended to relate a rotating component, to a stationary component such as a rotating blade and stationary casing or a rotating casing and a stationary blade or vane. The rotating component can be radially inward or radially outward of the stationary component. The term aerofoil is intended to mean the aerofoil portion of a rotating blade or stationary vane.

The terms axial, radial and circumferential are made with reference to the rotational axis 20 of the engine.

Figure 3:
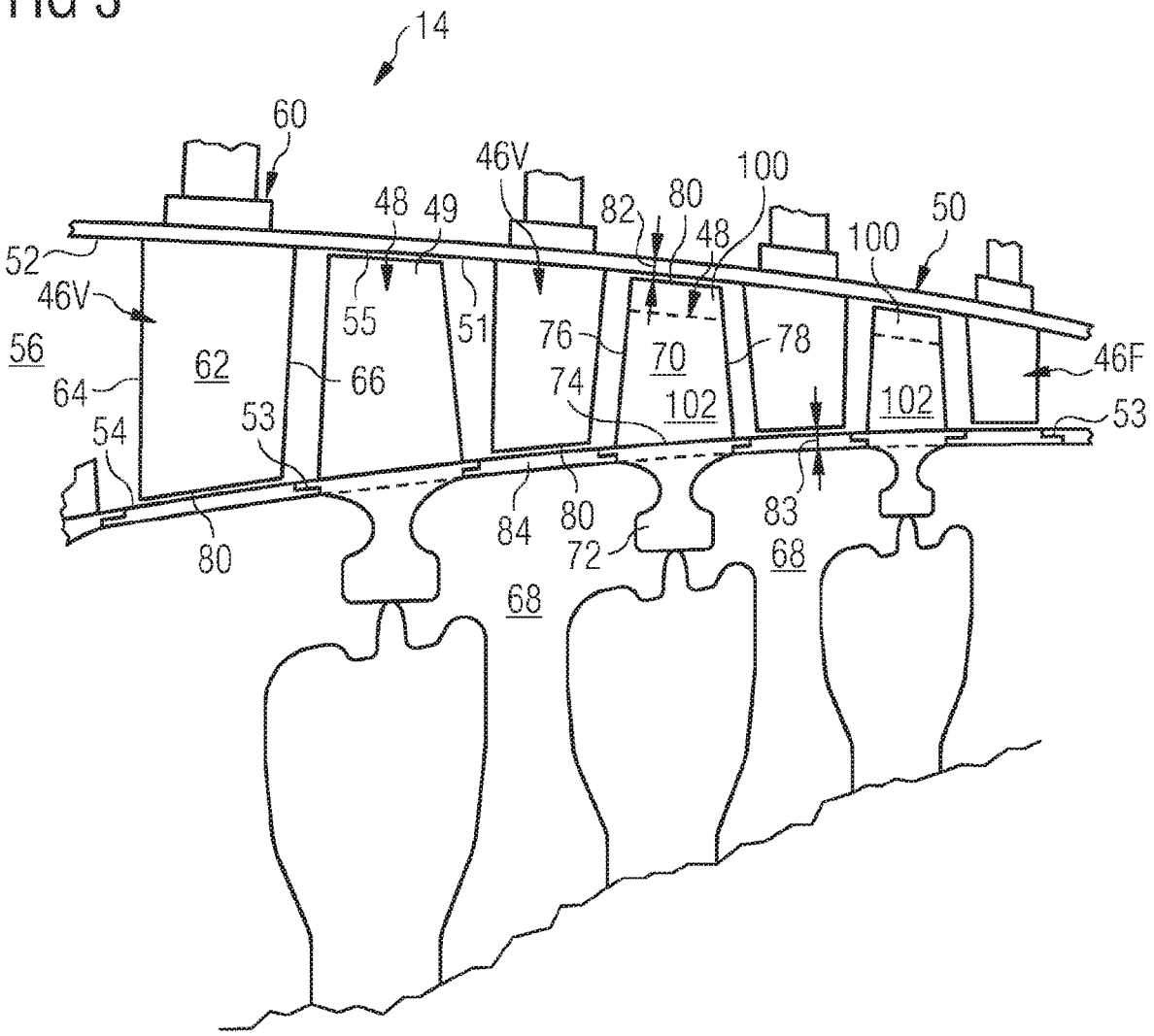
FIG. 3 shows an enlarged view of part of a compressor of the turbine engine of FIG. 2.

Referring to FIG. 3, the compressor 14 of the turbine engine 10 includes alternating rows of stator guide vanes 46 and rotatable rotor blades 48 which each extend in a generally radial direction into or across the passage 56.

The rotor blade stages 49 comprise rotor discs 68 supporting an annular array of blades. The rotor blades 48 are mounted between adjacent discs 68, but each annular array of rotor blades 48 could otherwise be mounted on a single disc 68. In each case the blades 48 comprise a mounting foot or root portion 72, a platform 74 mounted on the foot portion 72 and an aerofoil 70 having a leading edge 76, a trailing edge 78 and a blade tip 80. The aerofoil 70 is mounted on the platform 74 and extends radially outwardly therefrom towards the surface 52 of the casing 50 to define a blade tip gap, hg (which may also be termed a blade clearance 82).

The radially inner surface 54 of the passage 56 is at least partly defined by the platforms 74 of the blades 48 and compressor discs 68. In the alternative arrangement mentioned above, where the compressor blades 48 are mounted into a single disc the axial space between adjacent discs may be bridged by a ring 84, which may be annular or circumferentially segmented. The rings 84 are clamped between axially adjacent blade rows 48 and are facing the tip 80 of the guide vanes 46. In addition as a further alternative arrangement a separate segment or ring can be attached outside the compressor disc shown here as engaging a radially inward surface of the platforms.

FIG. 3 shows two different types of guide vanes, variable geometry guide vanes 46V and fixed geometry guide vanes 46F. The variable geometry guide vanes 46V are mounted to the casing 50 or stator via conventional rotatable mountings 60. The guide vanes comprise an aerofoil 62, a leading edge 64, a trailing edge 66 and a tip 80. The rotatable mounting 60 is well known in the art as is the operation of the variable stator vanes and therefore no further description is required. The guide vanes 46 extend radially inwardly from the casing 50 towards the radially inner surface 54 of the passage 56 to define a vane tip gap or vane clearance 83 there between.

Collectively, the blade tip gap or blade clearance 82 and the vane tip gap or vane clearance 83 are referred to herein as the 'tip gap hg'. The term 'tip gap' is used herein to refer to a distance, usually a radial distance, between the tip's surface of the aerofoil portion and the rotor drum surface or stator casing surface.

Although the aerofoil of the present disclosure is described with reference to the compressor blade and its tip, the aerofoil may also be provided as a compressor stator vane, for example akin to vanes 46V and 46F.

The present disclosure may relate to an un-shrouded compressor aerofoil and in particular may relate to a configuration of a tip of the compressor aerofoil to minimise aerodynamic losses.

The compressor aerofoil 70 comprises a suction surface wall 88 and a pressure surface wall 90 which meet at the leading edge 76 and the trailing edge 78. The suction surface wall 88 has a suction surface 89 and the pressure surface wall 90 has a pressure surface 91.

As shown in FIG. 3, the compressor aerofoil 70 comprises a root portion 72 spaced apart from a tip portion 100 by a main body portion 102.

Figure 4:
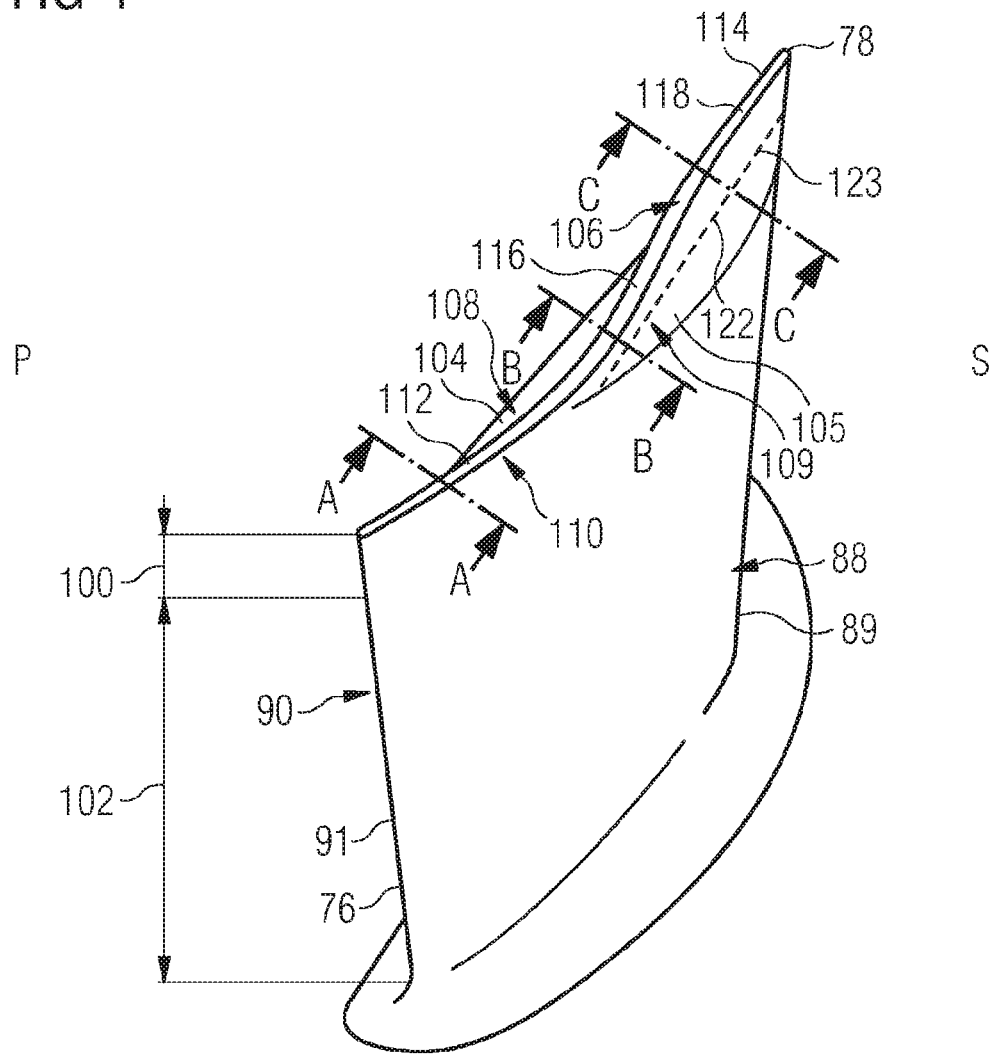
FIG. 4 shows part of a main body and a tip region of an aerofoil according to the present disclosure.
Figure 5A:
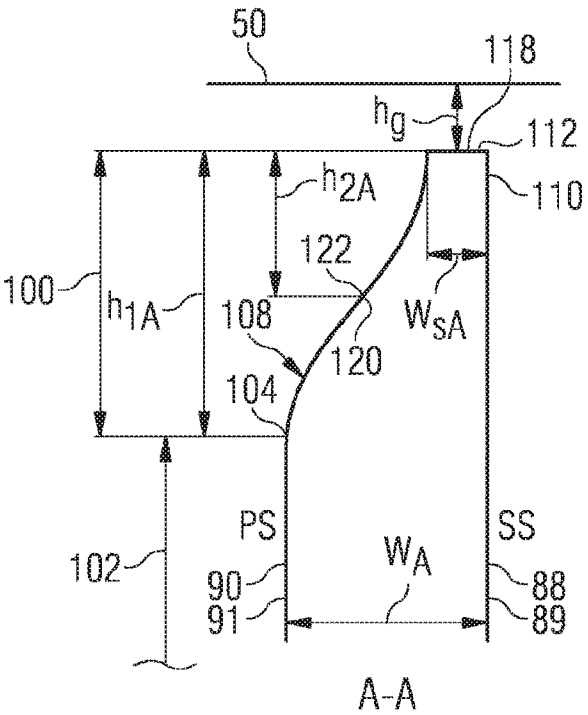
FIGS. 5*a*, 5*b*, 5*c* show sectional views of the aerofoil as indicated at A-A, B-B and C-C in FIG. 4.
Figure 5B:
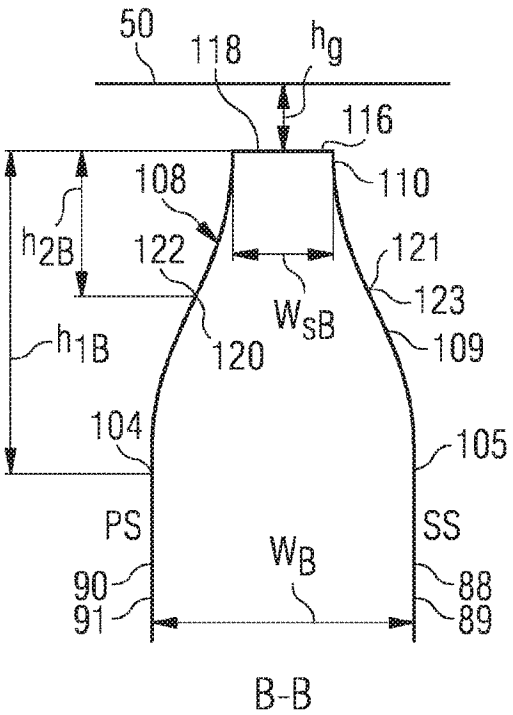
Figure 5C:
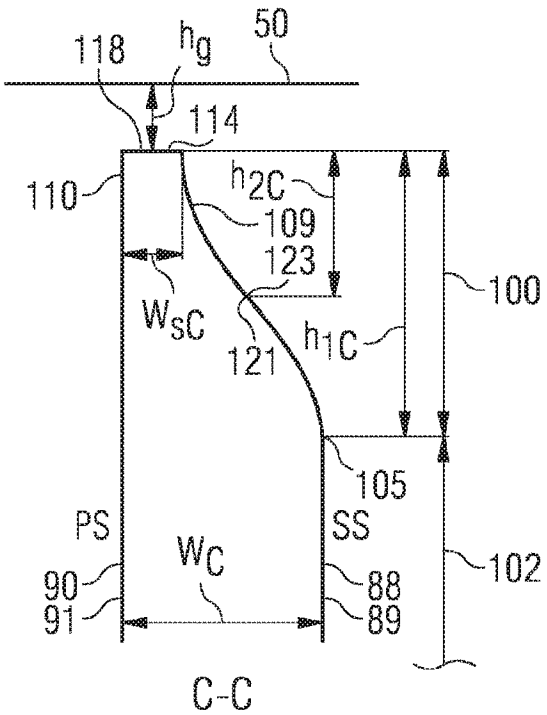
Figures 6, 7:
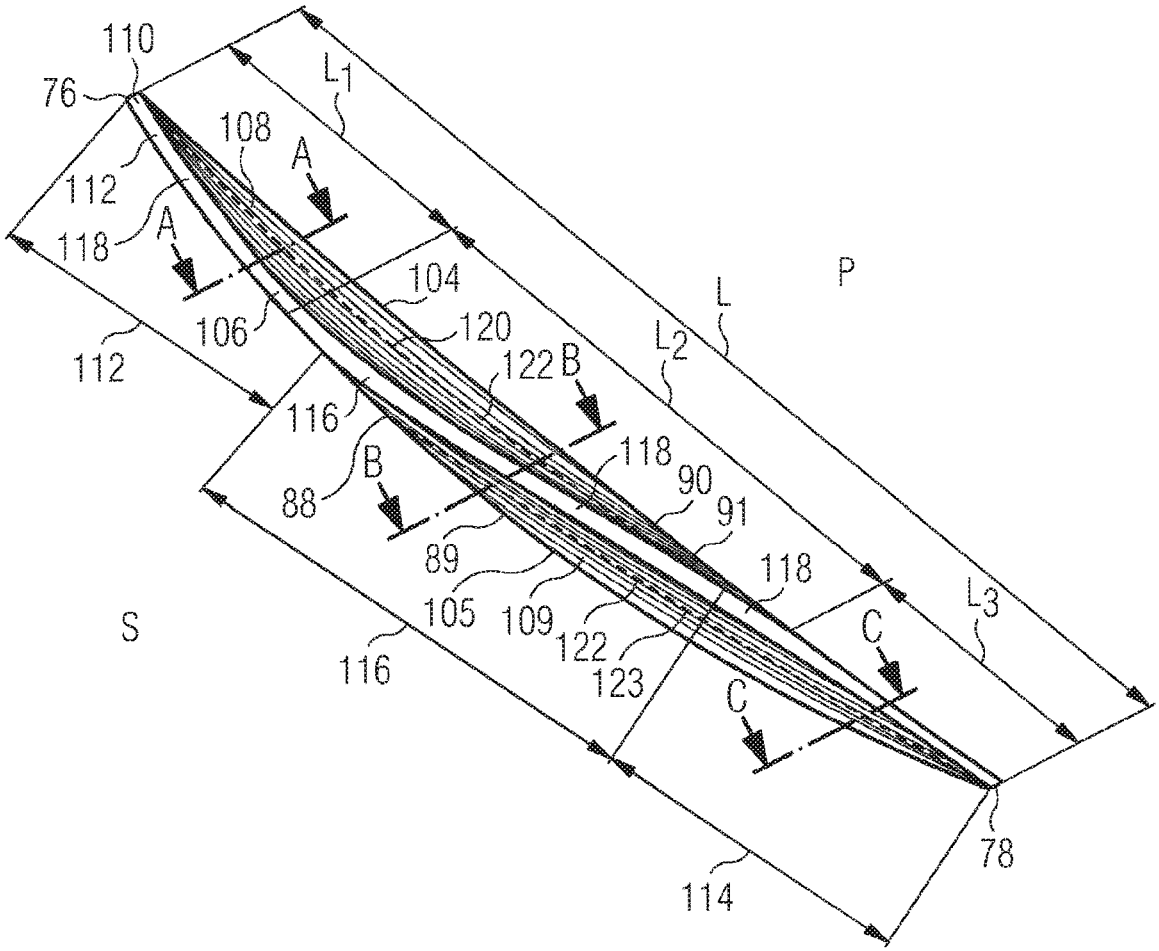
FIG. 6 shows an end on view of a part of the tip region of the aerofoil shown in FIG. 4.
FIG. 7 is a table of relative dimensions of the features shown in FIGS. 5*a*, 5*b*, 5*c*, 6.

FIG. 4 shows an enlarged view of part of a compressor aerofoil 70 according to the present disclosure. FIGS. 5*a*, 5*b*, 5*c* show sectional views of the aerofoil at points A-A, B-B and C-C respectively as indicated in FIG. 4. FIG. 6 shows an end on view of a part of the tip region of the aerofoil 70, and FIG. 7 summarises the relationship between various dimensions as indicated in FIGS. 5*a*, 5*b*, 5*c*, 6.

The main body portion 102 is defined by the convex suction surface wall 88 having a suction surface 89 and the concave pressure surface wall 90 having the pressure surface 91. The suction surface wall 88 and the pressure surface wall 90 meet at the leading edge 76 and the trailing edge 78.

The tip portion 100 comprises a tip wall 106 which extends from the aerofoil leading edge 76 to the aerofoil trailing edge 78. The tip wall 106 defines a squealer 110 comprising a first tip wall region 112 which extends from the leading edge 76 toward the trailing edge 78, a second tip wall region 114 which extends from the trailing edge 78 towards the leading edge 76, and a third tip wall region 116 which extends between the first tip wall region 112 and the second tip wall region 114.

The first tip wall region 112, third tip wall region 116 and second tip wall region 114 are arranged in series, extending from the leading edge 76 to the trailing edge 78. That is to say, the first tip wall region 112, third tip wall region 116 and second tip wall region 114 are joined to form a continuous tip wall 106 that provides the squealer 110. Thus the tip wall 106 defines a tip surface 118 which extends from the aerofoil leading edge 76 to the aerofoil trailing edge 78.

The three tip wall regions 112, 114, 116 may be considered as individual regions with their own physical attributes and, consequently, operational behaviour.

In the first tip wall region 112 a pressure-side shoulder 104 is provided on the pressure surface wall 90 which extends from the leading edge 76 part of the way, but not all of the way, towards the trailing edge 78. A transition region 108 of the pressure surface wall 90 tapers from the pressure-side shoulder 104 in a direction towards the tip wall 106 and tip surface 118. The suction surface 89 extends towards the first tip wall region 112. That is to say, in the tip section 100, the suction surface 89 extends in the same direction (i.e. with the same curvature) towards the tip wall 106 as it does in the main body portion 102. That is to say, in the first tip wall region 112, the suction surface 89 extends from the main body portion 102 without transition and/or change of direction towards the tip wall 106 and tip surface 118. Put another way, in the first tip wall region 112, a pressure side shoulder 104 is present, but no such shoulder is provided as part of the suction surface 89.

In the second tip wall region 114 a suction-side shoulder 105 is provided on the suction surface wall 88 which extends from the trailing edge 78 part of the way, but not all of the way, towards the leading edge 76. A transition region 109 of the suction surface wall 88 tapers from the suction-side shoulder 105 in a direction towards the second tip wall region 114 and tip surface 118. The pressure surface 91 extends towards the second tip wall region 114. That is to say, in the tip section 100, the pressure surface 91 extends in the same direction (i.e. with the same curvature) towards the tip wall 106 as it does in the main body portion 102. That is to say, in the second tip wall region 114, the pressure surface 91 extends from the main body portion 102 without transition and/or change of direction towards the tip wall 106 and tip surface 118. Put another way, in the second tip wall region 114, a suction side shoulder 105 is present, but no such shoulder is provided in the pressure surface 91.

In the third tip wall region 116 the pressure surface wall 90 transition region 108 tapers from the pressure-side shoulder 104 in a direction towards the tip wall 106, and the suction surface wall 88 transition region 109 tapers from the suction-side shoulder 105 in a direction towards the tip wall 106.

Thus, in the third tip wall region 116, there are provided both a pressure side shoulder 104 and a suction side shoulder 105, a pressure side transition region 108 and suction side transition region 109 which converge towards the tip wall 106 and tip surface 118 to form a squealer section that joins the leading edge squealer section and trailing edge squealer section.

As shown in FIGS. 5*a*, 5*b*, the transition region 108 of the pressure surface wall 90 extends from the shoulder 104 in a direction towards the suction surface 89, and at a pressure side inflexion point 120 the transition region 108 curves to extend in a direction away from the suction surface 89 toward the tip surface 118.

As shown in FIGS. 5*b*, 5*c* the transition region 109 of the suction surface wall 88 extends from the shoulder 105 in a direction towards the pressure surface 91, and at a suction side inflexion point 121 the transition region 109 curves to extend in a direction away from the pressure surface 91 toward the tip surface 118.

As shown in FIGS. 4 to 6, the pressure-side shoulder 104 substantially only overlaps the suction side shoulder 105 in the third tip wall section 116.

As best shown in FIG. 6, the tip portion 100 further comprises a pressure surface inflexion line 122 defined by a change in curvature on the pressure surface 91, the pressure side inflexion point 120 being provided on the pressure side inflexion line 122, the pressure side inflexion line 122 extending from the leading edge 76 part of the way to the trailing edge 78.

The tip portion 100 also comprises a suction surface inflexion line 123 defined by a change in curvature on the suction surface 89, the suction side inflexion point 121 being provided on the pressure side inflexion line 123, the suction side inflexion line 123 extending from the trailing edge 78 part of the way to the leading edge 76.

As shown in FIGS. 5*a*, 5*b*, 5*c*, the pressure side inflexion line 122 is provided a distance h2A from the tip surface 118 in the first tip wall region 112. The pressure side inflexion line 122 and suction side inflexion line 123 are provided a distance h2B from the tip surface 118 in the third tip wall region 116. The suction side inflexion line 123 is provided a distance h2C from the tip surface 118 in the second tip wall region 114. The shoulders 104, 105 are provided a distance h1A, h1B, h1C from the tip surface 118. The values of h1A, h1B, h1C may be equal in value to each other. The values of h2A, h2B, h2C may be equal in value to each other. h1A, h1B, h1C may have a value of at least 1.5, but no more than 2.7, of distance h2A, h2B, h2C respectively.

As shown in FIGS. 5*a*, 5*b*, 5*c* the pressure surface 91 and the suction surface 89 are spaced apart by a distance w (i.e. wA, wB, wC being distances at sections A-A, B-B, C-C respectively). The distance w decreases in value between a main body widest point and the leading edge 76. The value w also decreases in value between the main body widest point and the trailing edge 78.

That is to say, the pressure surface 91 and the suction surface 89 are spaced apart by a distance wB in a region corresponding to the third tip wall region 116, the distance wA between the pressure surface 91 and the suction surface 89 in the first tip wall region 112 decreases in value from the distance wB towards the leading edge 76, and the distance wC between the pressure surface 91 and the suction surface 89 in the second tip wall region 114 decreases in value from the distance wB towards the trailing edge 78.

The part of the tip surface 118 (i.e. squealer 110) corresponding to the first tip wall region 112 may taper in width wsA from the third tip wall region 116 to the leading edge 76.

The part of the tip surface 118 (i.e. squealer 110) corresponding to the second tip wall region 114 may taper in width wsC from the third tip wall region 116 to the trailing edge 78.

The squealer width wsA in the first tip wall region 112, may have a value of at least 0.3, but no more than 0.6, of the distance wA between pressure surface 91 and the suction surface 89 in the region of the main body portion 102 corresponding to the first tip wall region 112.

The squealer width wsC in the second first tip wall region 114, may have a value of at least 0.3, but no more than 0.6, of the distance wC between pressure surface 91 and the suction surface 89 in the region of the main body portion 102 corresponding to the second tip wall region 114.

The squealer width wsB in the third tip wall region 116, may have a value of at least 0.3, but no more than 0.6, of the distance wB between pressure surface 91 and the suction surface 89 in the region of the main body portion 102 corresponding to the third tip wall region 116.

The distances wA, wB and wC may vary in value along the length of the tip portion 100, and hence the distances wsA, wsB and wsC may vary accordingly.

As shown in FIG. 6, a chord line from the leading edge 76 to the trailing edge 78 has a length L.

For the avoidance of doubt, the term "chord" refers to an imaginary straight line which joins the leading edge 76 and trailing edge 78 of the aerofoil 70. Hence the chord length L is the distance between the trailing edge 78 and the point on the leading edge 76 where the chord intersects the leading edge.

In FIG. 6 the different tip wall sections are shown having chord lengths L1, L2, L3 which refer to sub-sections of the chord line L.

The first tip wall region 112 has a chord length L1, the second tip wall region 114 has a chord length L3 and the third tip wall region 116 has a chord length L2 wherein the sum of L1, L2 and L3 is equal to L.

The first tip wall region 112 may have a chord length L1 of at least 0.2 L but no more than 0.6 L. The second tip wall region 114 may have a chord length L3 of at least 0.2 L but no more than 0.6 L. The third tip wall region 116 may have a chord length L2 of at least 0.2 L but no more than 0.6 L.

Put another way, where a chord line from the leading edge 76 to the trailing edge 78 has a length L, the first tip wall region 112 has a chord length L1 of at least 0.2 L but no more than 0.6 L, the second tip wall region 114 has a chord length L3 of at least 0.2 L but no more than 0.6 L, and the third tip wall region 116 has a chord length L2 of at least 0.2 L but no more than 0.6 L, wherein the sum of L1, L2 and L3 is equal to L.

With reference to a compressor rotor assembly for a turbine engine comprising a compressor aerofoil according to the present disclosure, and as described above and shown in FIGS. 5*a*, 5*b*, 5*c*, the compressor rotor assembly comprises a casing 50 and a compressor aerofoil 70 wherein the casing 50 and the compressor aerofoil 70 define a tip gap, hg, defined between the tip surface and the casing.

In such an example the distance h2A, h2B, h2C from the inflexion line to the tip surface 118 has a value of at least about 1.5, but no more than about 3.5, of the tip gap hg. Put another way the distance h2A, h2B, h2C from the inflexion line to the tip surface 118 may have a value of at least about 1.5 hg but no more than about 3.5 hg.

Figure 1:
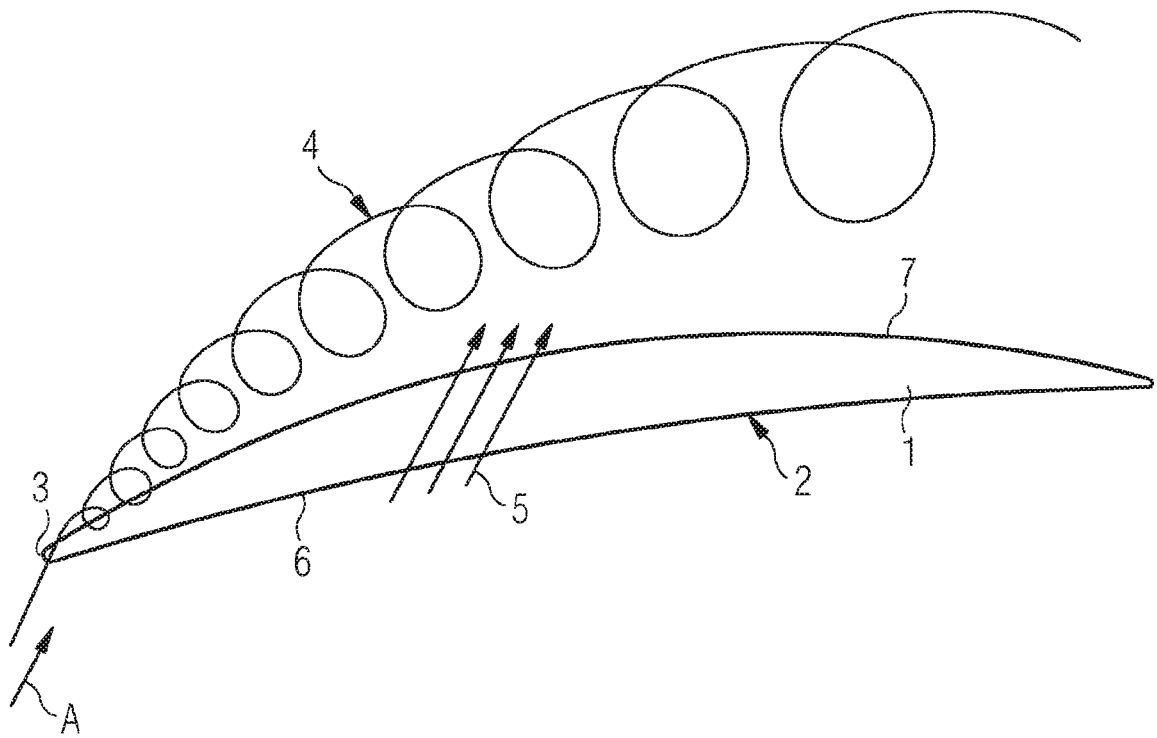
FIG. 1 shows an example aerofoil tip, as discussed in the background section.

In operation in a compressor, the geometry of the compressor aerofoil of the present disclosure differs in two ways from arrangements of the related art, for example as shown in FIG. 1.

The inflexions 120 (i.e. inflexion line 122) in the transition region 108 on the pressure side 90 which form the first tip wall region of the squealer 110 inhibits primary flow leakage reducing the pressure drop across the leading edge 76. This inhibits the flow of air directed radially (or with a radial component) along the pressure surface 91 towards the tip region 100, and hence the tip flow vortex formed is of lower intensity than those of the related art.

The squealer 110, being narrower than the overall width of the main body 102, results in the pressure difference across the tip surface 118 as a whole being lower than if the tip surface 118 had the same cross section as the main body 102. Hence secondary flow across the tip surface 118 will be less than in examples of the related art, and the primary flow vortex formed is consequently of lesser intensity as there is less secondary flow feeding it than in examples of the related art.

Additionally, since the squealer 110 of the aerofoil 70 is narrower than the walls of main body 102, the configuration is frictionally less resistant to movement than an example of the related art in which aerofoil tip has the same cross-section as the main body (for example as shown in FIG. 1). That is to say, since the squealer 110 of the present disclosure has a relatively small surface area, the frictional and aerodynamic forces generated by it with respect to the casing 50 will be less than in examples of the related art.

Thus the amount of over tip leakage flow flowing over the tip surface 118 is reduced, as is potential frictional resistance. The reduction in the amount of over tip leakage flow is beneficial because there is then less interaction with (e.g. feeding of) the over tip leakage vortex.

Hence there is provided an aerofoil rotor blade and/or stator vane for a compressor for a turbine engine configured to reduce tip leakage flow and hence reduce strength of the interaction between the leakage flow and the main stream flow which in turn reduces overall loss in efficiency.

As described, the aerofoil is reduced in thickness towards its tip to form a squealer portion on the suction (convex) side of the aerofoil extending from the its leading edge towards the trailing edge, another squealer portion on the pressure (concave) side of the aerofoil extending from the trailing edge towards the leading edge, and a further squealer bridge portion which extends between, and links, the other squealer portions. This arrangement reduces the pressure difference across the tip and hence reduces secondary leakage flow. The squealer provided near the leading edge acts to diminish primary leakage flow. Together, these features reduce the tip leakage mass flow thus diminishing the strength of the interaction between the leakage flow and the main stream flow which in turn reduces the loss in efficiency.

Hence the compressor aerofoil of the present disclosure results in a compressor of greater efficiency compared to known arrangements.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A compressor aerofoil for a turbine engine, the compressor aerofoil comprising:

a root portion spaced apart from a tip portion by a main body portion;

wherein the main body portion is defined by: a suction surface wall having a suction surface, a pressure surface wall having a pressure surface, whereby the suction surface wall and the pressure surface wall meet at a leading edge and a trailing edge, wherein the tip portion comprises a tip wall which extends from the leading edge to the trailing edge;

wherein the tip wall defines a squealer comprising:

a first tip wall region which extends from the leading edge;

a second tip wall region which extends from the trailing edge;

a third tip wall region which extends between the first tip wall region and the second tip wall region, wherein the first tip wall region, the third tip wall region and the second tip wall region are joined to form a continuous tip wall that constitutes the squealer;

wherein in the first tip wall region a pressure-side shoulder provided on the pressure surface wall extends from the leading edge part of the way towards the trailing edge; a transition region of the pressure surface wall tapers from the pressure-side shoulder in a direction towards the tip wall; and the suction surface extends towards the first tip wall region;

wherein in the second tip wall region a suction-side shoulder provided on the suction surface wall extends from the trailing edge part of the way towards the leading edge; a transition region of the suction surface wall tapers from the suction-side shoulder in a direction towards the tip wall; and the pressure surface extends towards the second tip wall region;

wherein in the third tip wall region the pressure surface wall transition region tapers from the pressure-side shoulder in a direction towards the tip wall; and the suction surface wall transition region tapers from the suction-side shoulder in a direction towards the tip wall.

2. The compressor aerofoil as claimed in claim 1, wherein the pressure-side shoulder substantially only overlaps the suction side shoulder in the third tip wall region.

3. The compressor aerofoil as claimed in claim 1, wherein the first tip wall region tapers in width wsA from the third tip wall region to the leading edge; and the second tip wall region tapers in width wsC from the third tip wall region to the trailing edge.

4. The compressor aerofoil as claimed in claim 3, wherein a squealer width wsA in the first tip wall region has a value of at least 0.3, but no more than 0.6, of a distance wA between pressure surface and the suction surface in the region of the main body portion corresponding to the first tip wall region;

wherein a squealer width wsC in the second tip wall region has a value of at least 0.3, but no more than 0.6, of a distance wC between pressure surface and the suction surface in the region of the main body portion corresponding to the second tip wall region; and wherein a squealer width wsB in the third tip wall region has a value of at least 0.3, but no more than 0.6, of a distance wB between pressure surface and the suction surface in the region of the main body portion corresponding to the third tip wall region.

5. The compressor aerofoil as claimed in claim 1, wherein a chord line from the leading edge to the trailing edge has a length L; and the first tip wall region has a chord length L1, the second tip wall region has a chord length L3, and the third tip wall region has a chord length L2, wherein a sum of L1, L2 and L3 is equal to L.

6. The compressor aerofoil as claimed in claim 5, wherein the first tip wall region has a chord length L1 of at least 0.2 L but no more than 0.6 L.

7. The compressor aerofoil as claimed in claim 5, wherein the second tip wall region has a chord length L3 of at least 0.2 L but no more than 0.6 L.

8. The compressor aerofoil as claimed in claim 5, wherein the third tip wall region has a chord length L2 of at least 0.2 L but no more than 0.6 L.

9. The compressor aerofoil as claimed in claim 1, wherein the tip wall defines a tip surface which extends from the leading edge to the trailing edge;

wherein the transition region of the pressure surface wall extends from the pressure side shoulder in a direction towards the suction surface, and at a pressure side inflexion point the transition region curves to extend in a direction away from the suction surface toward the tip surface;

wherein the transition region of the suction surface wall extends from the suction side shoulder in a direction towards the pressure surface, and at a suction side inflexion point the transition region curves to extend in a direction away from the pressure surface toward the tip surface.

10. The compressor aerofoil as claimed in claim 9, wherein the tip portion further comprises:

a pressure surface inflexion line defined by a change in curvature on the pressure surface; the pressure side inflexion point being provided on the pressure side inflexion line; the pressure side inflexion line extending from the leading edge part of the way to the trailing edge; and a suction surface inflexion line defined by a change in curvature on the suction surface; and the suction side inflexion point being provided on the pressure side inflexion line; the suction side inflexion line extending from the trailing edge part of the way to the leading edge.

11. The compressor aerofoil as claimed in claim 10, wherein:

the pressure side inflexion line is provided a distance h2A from the tip surface in the first tip wall region;

the pressure side inflexion line and suction side inflexion line are provided a distance h2B from the tip surface in the third tip wall region; and the suction side inflexion line is provided a distance h2C from the tip surface in the second tip wall region; and the shoulders are provided a distance h1A, h1B, h1C from the tip surface; where:

h1A, h1B, h1C are equal in value to each other;

h2A, h2B, h2C are equal in value to each other; and h1A, h1B, h1C have a value of at least 1.5, but no more than 2.7, of distance h2A, h2B, h2C respectively.

12. A compressor rotor assembly for a turbine engine, the compressor rotor assembly comprising:

a casing, and a compressor aerofoil as claimed in claim 11, wherein the casing and the compressor aerofoil define a tip gap hg defined between the tip surface and the casing, wherein the distance h2A, h2B, h2C from the inflexion line to the tip surface has a value of at least 1.5 hg but no more than 3.5 hg.

13. The compressor aerofoil as claimed in claim 1, wherein:

the pressure surface and the suction surface are spaced apart by a distance wB in a region corresponding to the third tip wall region; and a distance wA between the pressure surface and the suction surface in the first tip wall region decreases in value from the distance wB towards the leading edge; and the distance wB between the pressure surface and the suction surface in the second tip wall region decreases in value from the distance wB towards the trailing edge.

14. A compressor rotor assembly for a turbine engine, the compressor rotor assembly comprising:

a casing, and a compressor aerofoil as claimed in claim 1, wherein the casing and the compressor aerofoil define a tip gap hg defined between the tip surface and the casing.

* * * * *